US008099933B2

(12) United States Patent
Benedetti et al.

(10) Patent No.: US 8,099,933 B2
(45) Date of Patent: Jan. 24, 2012

(54) PROCESS OF MANUFACTURING SEALED PACKAGES CONTAINING A POURABLE FOOD PRODUCT AND PACKAGING EQUIPMENT FOR PERFORMING SUCH PROCESS

(75) Inventors: Paolo Benedetti, Modena (IT); Nelcio Carlos Do Amaral, Limhamn (SE); Gabor Benkö, Lund (SE); Gert Ask, Blentarp (SE); Magnus Dahl, Staffanstorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 135 days.

(21) Appl. No.: 12/438,834

(22) PCT Filed: Oct. 18, 2007

(86) PCT No.: PCT/EP2007/061172

§ 371 (c)(1),
(2), (4) Date: Feb. 25, 2009

(87) PCT Pub. No.: WO2008/046896

PCT Pub. Date: Apr. 24, 2008

(65) Prior Publication Data

US 2010/0016137 A1 Jan. 21, 2010

(30) Foreign Application Priority Data

Oct. 19, 2006 (EP) ..... 06122623

(51) Int. Cl.
*B65B 9/00* (2006.01)

(52) U.S. Cl. ..... 53/451; 53/452; 53/550

(58) Field of Classification Search ..... 53/550, 53/451, 452, 459, 551, 554, 555; 493/254, 493/11, 34, 196

See application file for complete search history.

(56) References Cited

U.S. PATENT DOCUMENTS

| | | | | | |
|---|---|---|---|---|---|
| 3,796,862 | A | * | 3/1974 | Asija | 235/462.02 |
| 4,011,708 | A | * | 3/1977 | Brown, Jr. | 53/570 |
| 4,013,893 | A | * | 3/1977 | Hertig | 250/568 |
| 4,287,797 | A | * | 9/1981 | Seragnoli | 83/74 |
| 4,380,446 | A | * | 4/1983 | Dickson et al. | 493/11 |
| 4,515,481 | A | * | 5/1985 | Yamada et al. | 356/400 |
| 4,600,841 | A | * | 7/1986 | Tokuno et al. | 250/548 |

(Continued)

FOREIGN PATENT DOCUMENTS

| | | | |
|---|---|---|---|
| EP | 0 357 841 | B1 | 3/1990 |
| EP | 0 693 424 | B1 | 1/1996 |
| FR | 2 733 733 | A1 | 11/1996 |
| GB | 1 296 251 | A | 11/1972 |
| WO | WO 2004/045953 | A1 | 6/2004 |

OTHER PUBLICATIONS

International Search Report (PCT/ISA/210) dated Jan. 7, 2008. Written Opinion of the International Searching Authority (PCT/ISA/237) dated Jan. 7, 2008.

*Primary Examiner* — Sameh H. Tawfik

(74) *Attorney, Agent, or Firm* — Buchanan Ingersoll & Rooney PC

(57) ABSTRACT

A process of manufacturing sealed packages containing a pourable food product from a web packaging material moving along a predetermined path involves providing a recurring pattern of printed register marks on the web packaging material, applying a recurring pattern of bend or fold lines on the web packaging material as a function of the detected position of the printed register marks, generating new references, distinct from the bend or fold lines, on the web packaging material in a synchronized way with the application of the recurring pattern of bend or fold lines; and performing one or more subsequent operations on the web packaging material based on a synchronization pulse created by detection of the new references.

10 Claims, 5 Drawing Sheets

U.S. PATENT DOCUMENTS 4,614,430 A * 9/1986 Hara et al. ..... 382/149
4,698,514 A * 10/1987 Hilmersson et al. ..... 250/566
4,781,090 A * 11/1988 Feldkamper et al. ..... 83/74
5,001,325 A * 3/1991 Huizinga ..... 219/121.69
5,421,802 A * 6/1995 Landeck et al. ..... 493/22
5,876,317 A 3/1999 Sigrist et al.
6,046,427 A 4/2000 Richter et al.
2005/0252175 A1 11/2005 Martin

* cited by examiner

PROCESS OF MANUFACTURING SEALED PACKAGES CONTAINING A POURABLE FOOD PRODUCT AND PACKAGING EQUIPMENT FOR PERFORMING SUCH PROCESS

TECHNICAL FIELD

The present invention relates to a process of manufacturing sealed packages containing a pourable food product and to a packaging equipment for performing such process.

BACKGROUND ART

As it is known, many pourable food products, such as fruit juice, UHT (ultra-high-temperature processed) milk, wine, tomato sauce, etc., are sold in packages made of sterilized sheet packaging material.

A typical example of this type of packages is the parallelepiped-shaped package for liquid or pourable food products known as Tetra Brik Aseptic (registered trademark), which is made by folding and sealing laminated sheet packaging material.

The packaging material has a multilayer structure substantially comprising a base layer for stiffness and strength, which may be defined by a layer of fibrous material, e.g. paper, or mineral-filled polypropylene material, and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As it is known, packages of this sort are produced on fully automatic packaging machines from a continuous web of packaging material, which may be cut to form blanks or longitudinally sealed to form a tube of packaging material.

In the latter case, which will be referred to hereinafter without loss of its general sense, the web of packaging material is loaded into the packaging machine in the form of a reel, from which it continuously unwinds, and is fed to an aseptic chamber for sterilization, e.g. by applying a sterilizing agent such as hydrogen peroxide, which is later vaporized by heating, and/or by subjecting the packaging material to radiation of appropriate wavelength and intensity.

The sterilized web is then folded into a cylinder and sealed longitudinally to form, in known manner, a continuous, vertical, longitudinally sealed tube, which forms an extension of the aseptic chamber; the tube of packaging material is filled continuously with sterilized or sterile-processed pourable food product and then fed to a form-and-seal unit for forming the individual packages.

The form-and-seal unit comprises pairs of jaws that are cyclically brought into contact with the tube to grip and seal it at equally spaced cross sections and to form so-called "pillow packs" connected to the tube by transverse sealing strips.

The pillow packs are then separated from the tube by cutting the relative transverse sealing strips, and are conveyed to a folding station where they are folded mechanically to form respective finished, e.g. parallelepiped-shaped, packages.

To allow folding of the web packaging material both during forming and final folding, bend or fold lines, i.e. creased or weakened lines, defining a so-called "crease pattern" are embossed on the packaging material at the production line (creasing operation).

More specifically, the web packaging material is produced in converting plants where a paperboard, a prelaminated paperboard or the like, typically including a paper layer covered on one side with layers of heat-seal plastic material and barrier material, is subjected to a number of successive processing operations including the above-mentioned creasing operation.

Typical examples of successive processing operations performed on the web at the converting plant are:

- printing a repeated design pattern, usually made in multiple successive print units, e.g. one unit for printing each colour;
- embossing a repeated pattern of bend or fold lines (crease pattern);
- perforating, scoring or cutting the web material through mechanical or laser devices; and
- forming a further heat-seal plastic material layer on the printed side.

In order to assure that all discrete operations both at the converting plant and in the packaging machine are in register with one another, i.e. made at correct relative positions on the web, register marks must be provided on the web.

According to a known process, this aim is achieved by printing a first and a second register mark on the web at the first print unit. The first register mark is used in the successive steps of the converting process to determine the actual position of the web in order to perform the successive operations, such as printing the remaining colours, creasing, and laser-processing, mechanical perforating, hole punching, etc., if any. The second register mark is used in the packaging machine in order to control the feed of the tube of packaging material and the forming operations thereon.

EP-B-0357841 discloses a method of providing score lines in a web packaging material through a laser device, which is triggered by the detection of a recurring printed register mark on said material.

Printed marks to detect the longitudinal position of the web material have been used for many years, are simple to produce and easy to read; in fact, the printed mark is simply a portion of the package design and thus does not bring about any additional cost. However, being a portion of the printed design means that the register mark itself is, for instance, not perfectly in register with the respective bend or fold lines, because printing and creasing steps are two different successive operations in web material production and, although relative shifts between the two operations are kept to a minimum, there are inherent tolerances in the production process (print-to-crease tolerances). This may cause problems in successive packaging operations, wherein the packaging material is positioned according to the printed marks in order to be folded at the bend or fold lines.

In general, the use of a printed register mark for successive operations implies that such operations are performed with a position error, depending on the process tolerances, which is referred to the printed mark. This means that any result of a successive operation (printed design, crease pattern, laser pattern, etc.) may have a positive or negative position error with respect to a theoretical position determined by the printed mark; the absolute value of the error is comprised within a maximum value depending on the process tolerances. In case two successive operations which have a functional impact when forming and filling packages, such as the crease pattern and the laser pattern, happen to be subjected to errors in opposite directions, the tolerance chain may produce a relative error between such operations which is up to the sum of the tolerance widths of each single operation.

To eliminate the above-mentioned relative error between the operations for making the crease pattern and the laser pattern, it has been proposed in U.S. Pat. No. 6,046,427 to detect the position of the bend or fold lines on the packaging material for triggering the laser device. This method allows to avoid generating the print-to-crease tolerances but introduces other problems.

In particular, if a bend or fold line is used as a "register mark", the position of the web material in a given, e.g. longitudinal, direction can be detected provided that such bend or fold line is correctly identified with respect to the other bend or fold lines forming the crease pattern. This would require to use an additional reference code, e.g. a printed code, to trigger a "reading window", or alternatively extremely complicated sensors.

Moreover, such sensors can be used to detect bend or fold lines on flat material in converting operations, but are not suitable for use in a tube-fed packaging machine in which there is:

- the physical pulsating movement of the pourable food product within the tube of packaging material during filling and packaging operations due to internal pressure changes;
- the vertical displacements in the tube-feed direction;
- the horizontal displacements in the horizontal "tube twisting" direction; and
- the arduous conditions of the working environment in which the sensors would have to operate.

Therefore, it is necessary to provide additional printed marks adapted to be read more easily in the tube-fed packaging machine or to use different optically readable indicia, such as the position of a web edge, or prelaminated holes for opening devices, or the longitudinal seal of the tube; however, these indicia are difficult to detect for the reasons above-mentioned, and in any case require dedicated sensors.

To sum up, although effective to eliminate the "print-to-crease" tolerances, the proposal contained in U.S. Pat. No. 6,046,427 still requires two detection systems, one for printed or optically detectable indicia, the other for bend or fold lines.

DISCLOSURE OF INVENTION

A scope of the present invention is to provide a process of manufacturing sealed packages containing a pourable food product, which overcomes the above-mentioned drawbacks of the prior art.

BRIEF DESCRIPTION OF THE DRAWINGS

Two preferred, non limiting embodiments of the present invention are described hereinafter by way of example with reference to the appended drawings, in which.

BEST MODE FOR CARRYING OUT THE INVENTION

Figure 1:
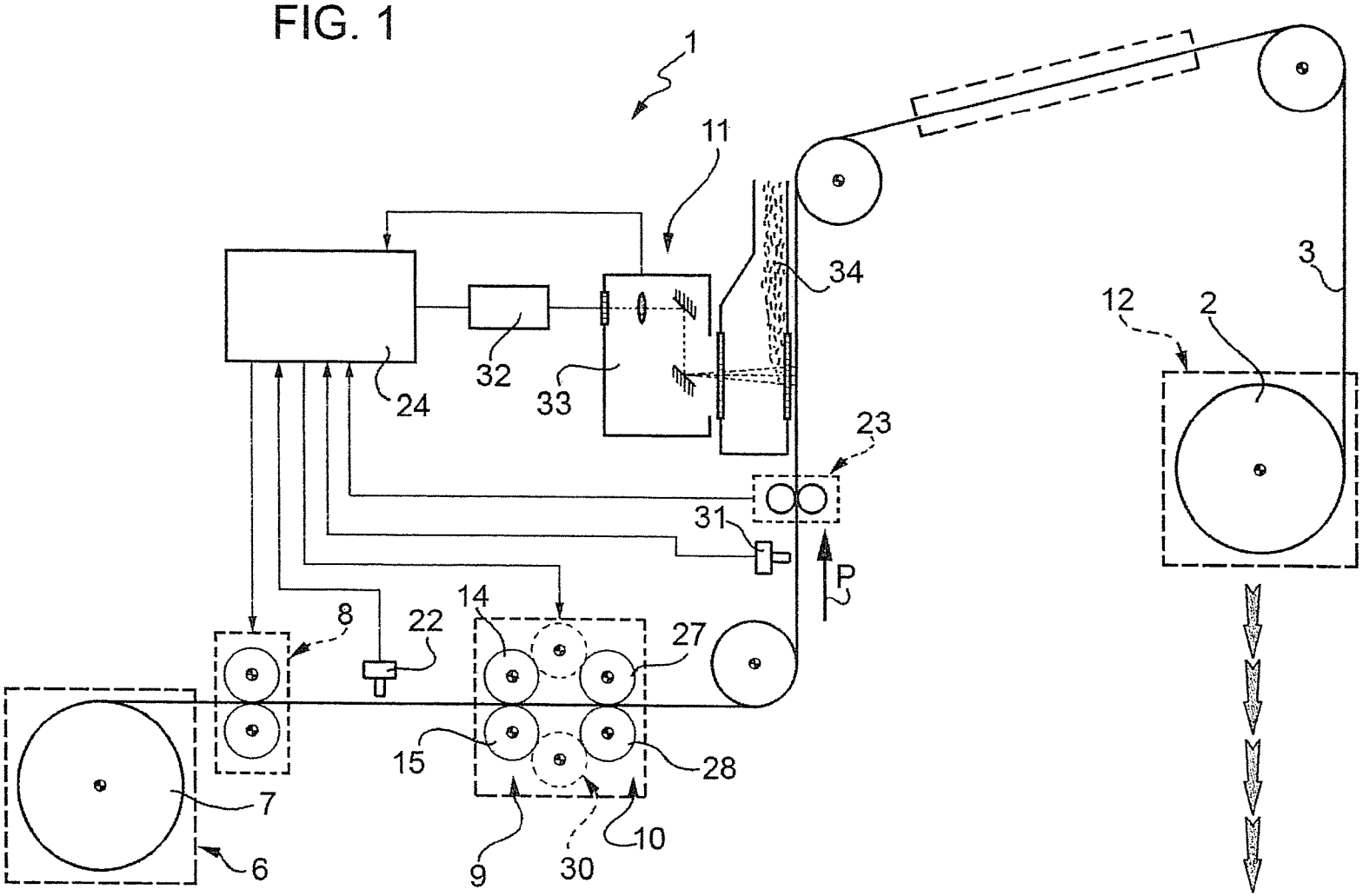
FIG. 1 shows, schematically, a converting plant for performing the process of the present invention on a web packaging material.

Numeral 1 in FIG. 1 indicates as a whole a converting plant for producing reels 2 of web packaging material 3 to be used in a forming/filling machine 4 (FIG. 2) for producing sealed packages 5 containing pourable food products.

Plant 1 and machine 4 define successive units of a packaging equipment for forming sealed packages 5 from a raw web packaging material fed along a predetermined path P.

Plant 1 essentially includes an unwinder 6, in which reels 7 of raw web material are loaded, a number of processing stations 8, 9, 10, 11 described hereunder in detail and located along path P, and a winder 12 where reels 2 of finished web packaging material 3 are formed.

The first processing station is a print station 8, per se known, adapted to print a register mark 13 on web packaging material 3 (FIG. 3), which is used to determine the actual position of the web in the successive processing station 9. Register mark 13 is repeated along web packaging material 3 at a pitch R (FIG. 3) corresponding to the web length (repeat-length) which is necessary to manufacture a package 5.

Figure 3:
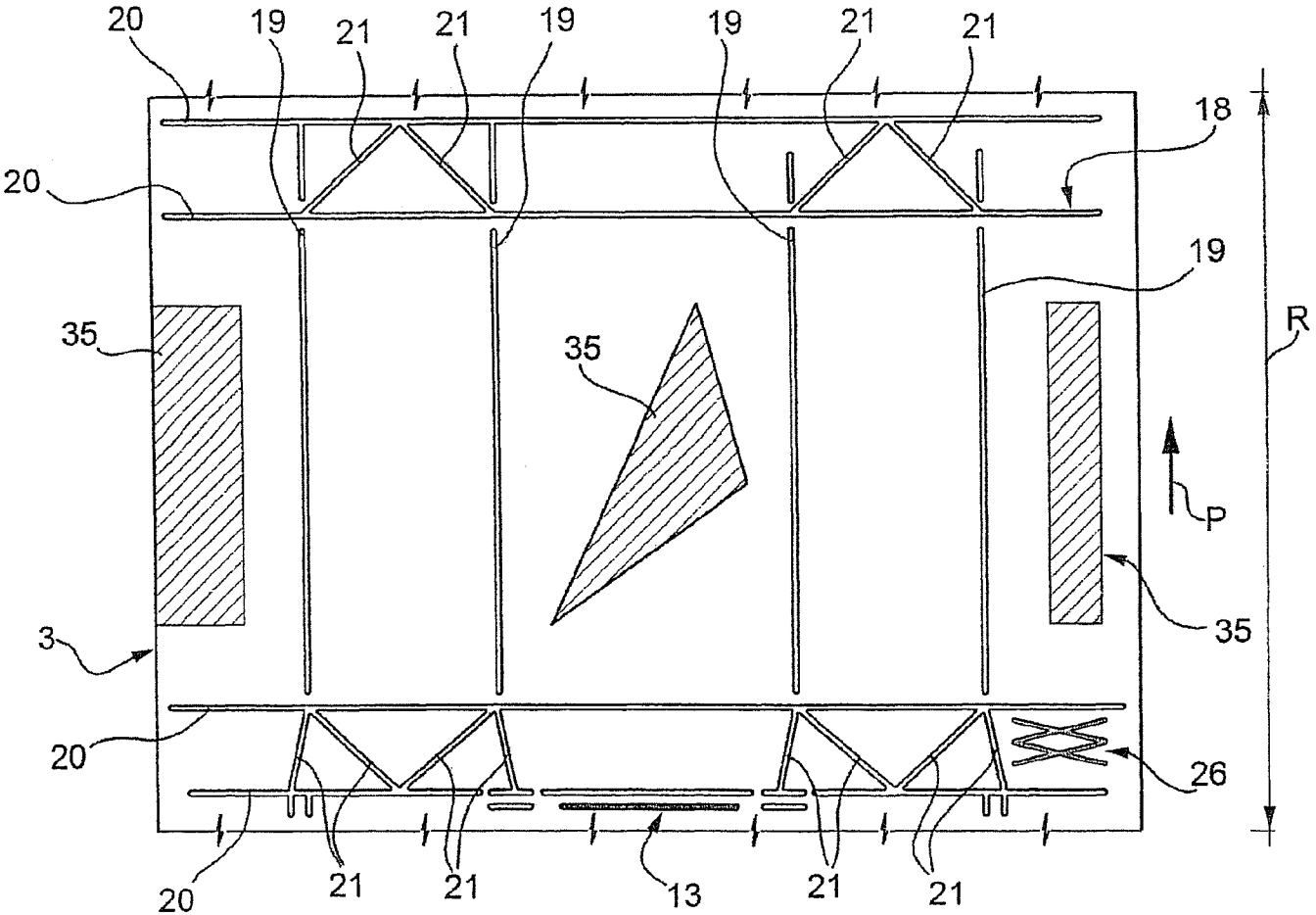
FIG. 3 shows a portion of the web packaging material of FIGS. 1 and 2, at an enlarged scale.

In the embodiment of FIG. 3, which is only a possible example having no limiting function, register mark 13 consists of a straight line extending orthogonally to path P and having predetermined length and thickness. As shown in FIG. 3, register mark 13 is located in the middle of bottom end of the repeatlength of web packaging material 3.

The next processing station is a creasing station 9, wherein web packaging material 3 is fed between a couple of creasing rollers 14, 15 having, for instance, complementary crease profiles (not shown), i.e. projecting ribs on one roller and grooves on the other, which locally delaminate web packaging material 3 along predetermined lines defining a repeated pattern 18 of bend or fold lines, conveniently known as "crease pattern".

Each crease pattern 18 (FIG. 3) includes, in a known manner, a plurality of longitudinal bend or fold lines 19, corresponding to the vertical corners of the finished packages, and a plurality of transverse bend or fold lines 20 corresponding to the horizontal corners of the package and the base of the transversal seal portions or "fins".

Inclined bend or fold lines 21, mainly inclined by 45° but also present at different angles with respect to the longitudinal direction, appear in the top and bottom part of crease pattern 18 and define the package flaps.

The position of web packaging material 3 at creasing station 9 is detected by a sensor 22 which reads register marks 13. In the example shown in the enclosed figures, the speed of web packaging material 3 is measured by an incremental shaft encoder 23 (known per se) using the peripheral speed of the rollers located there or by a contactless measuring device, e.g. with a laser Doppler anemometer (not shown).

Web feed at creasing station 9, and therefore the register of crease pattern 18, is controlled by a control unit 24 in response to sensor 22 and to incremental shaft encoder 23.

Since print and creasing stations 8, 9 perform different successive operations on web packaging material 3, perfect registration between each register mark 13 and the respective bend or fold lines 19, 20, 21 cannot be ensured due to inherent tolerances in the production process (print-to-crease tolerances) as above discussed.

In order to make the print-to-crease tolerances uninfluential on the successive operations performed at converting plant 1 and even in packaging machine 4, the next processing station is an applying station 10 for applying, on web packaging material 3, a new register mark 26, which is distinct from, and perfectly in register with, the respective bend or fold lines 19, 20, 21; advantageously, applying station 10 is synchronized with creasing station 9 so that register marks are applied during the creasing operation performed by creasing station 9.

In the example shown, applying station 10 includes a couple of applying rollers 27, 28, between which web packaging material 3 is fed. According to the embodiment shown in FIG. 1, the synchronization between applying station 10 and creasing station 9 is obtained by a mechanical coupling between the two couples of rollers 14, 15 and 27, 28, e.g. by means of a gear transmission 30 (schematically indicated in FIG. 1 by a dotted line).

Figure 4:
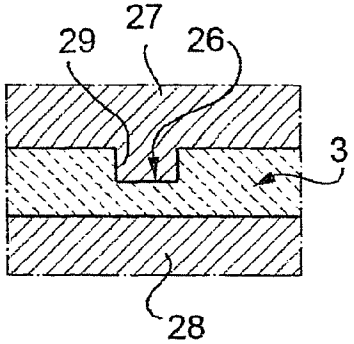
FIG. 4 shows a larger-scale cross section of a detail of a processing station of the FIG. 1 converting plant.

Preferably, as shown in detail in FIG. 4, applying rollers include a roller 27 having radially protruding ribs 29 and a counter-roller 28 which is purely cylindrical, i.e. without any corresponding indentation. Due to this structure of the applying rollers 27, 28, the resulting register mark 26 is defined by compression lines, i.e. lines compressed on one side only of web packaging material 3.

Alternatively, register mark 26 may be obtained by using a conventional printing technology, such as the one used in print station 8, or by means of male-female creasing rollers, such as the ones used in creasing station 9.

In the embodiment of FIG. 3, register mark 26 is located at one of the bottom corners of the repeatlength of web packaging material 3 and includes four inclined lines, parallel in pairs and defining two crosses that are offset from one another in the web feeding direction, i.e. along path P.

The next processing station is a laser station 11 adapted to perform a structure-modifying operation, such as a cutting, perforating, creasing or scoring operation, on web packaging material 3 by local vaporization thereof with a controllable laser beam movable from a fixed point in at least two perpendicular directions.

The operation performed by laser station 11 creates a repeated laser pattern (not shown) on web packaging material 3 and is based on a synchronization pulse created by detection of the position of recurring register mark 26 through a sensor 31.

More specifically, laser station 11 is controlled by control unit 24 as a function of the position of register marks 26 as detected by sensor 31 and also the speed of web packaging material 3 as detected by incremental shaft encoder 23.

Laser station 11 basically comprises a laser source 32 for generating the laser beam and a scanner 33 (well known in the art per se), including movable mirrors and lenses, for deflecting the laser beam in at least two perpendicular directions so as to create the desired pattern.

In addition, a fumes exhaust unit 34 is shown adjacent to the treatment area of web packaging material 3 by means of which the fumes created by local vaporization are drawn off.

Plant 1 may include one or more further processing stations, e.g. a further print station (known per se and not shown) for printing a repeated design pattern 35 (FIG. 3) on web packaging material 3, and a laminator (known per se and not shown) for producing a thermoplastic layer on one or both sides of web packaging material 3, and also for applying a gas- and light-barrier layer, where present, such as an aluminium foil layer. Also for these operations, register marks 26 are used as reference means.

According to a possible alternative not shown, the print station for printing repeated design pattern 35 may also be placed as first station in connection with print station 8 for printing register marks 13.

In the light of the above, the process of manufacturing web packaging material 3 performed by plant 1 includes the steps of:

- providing printed register marks 13 on web packaging material 3;
- applying a recurring pattern 18 of bend or fold lines 19, 20, 21 on web packaging material 3 as a function of the position of printed register marks 13;
- applying register marks 26 on web packaging material 3 in a synchronized way with the step of applying recurring pattern 18 of bend or fold lines 19, 20, 21; and
- performing subsequent operations, such as a laser operation, a design printing operation and a lamination, on web packaging material 3 based on a synchronization pulse created by detection of register marks 26.

Figure 2:
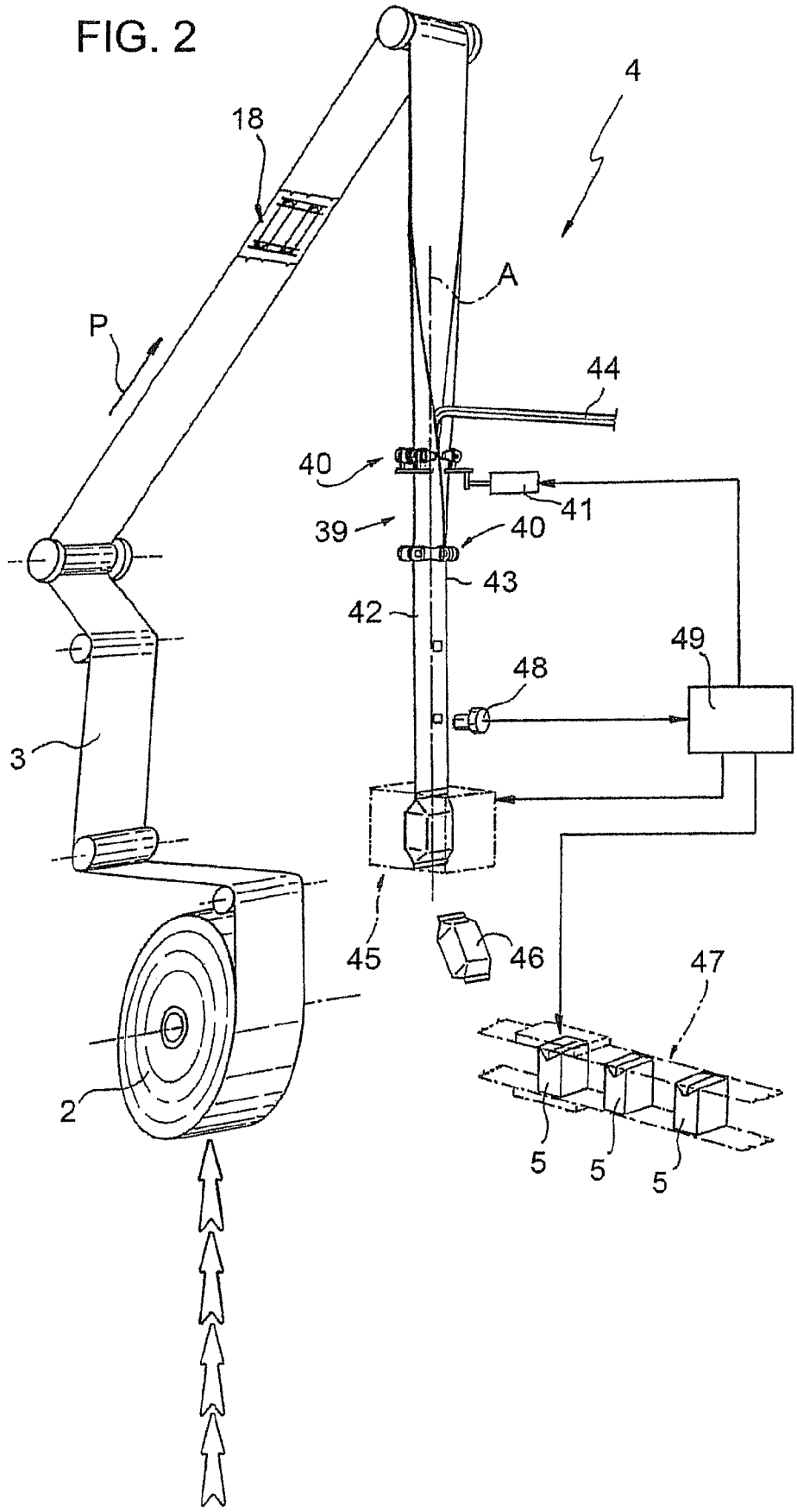
FIG. 2 shows, schematically, a forming/filling machine for producing sealed packages from the web packaging material manufactured by the FIG. 1 converting plant.

Packaging web material 3 is then used on forming/filling machine 4, shown schematically in FIG. 2, for producing aseptic packages 5; in particular, packaging web material 3 is unwound off reel 2 and fed along path P through an aseptic chamber (not shown), where it is sterilized, and through an assembly 39 (shown schematically in FIG. 2 and described in detail, for instance, in EP-A-1116659, whose content is incorporated therein by reference) by which it is folded gradually into a cylinder and sealed to form, in a known manner, a continuous vertical tube 42 having an axis A, coaxial to path P, and a longitudinal seam 43 parallel to that axis.

Briefly, assembly 39 includes a number of forming units 40 (only two of them are disclosed in FIG. 2 for simplicity), arranged successively along a vertical portion of path P and each made up of folding rollers, which have axes perpendicular to such vertical portion of path P and define respective compulsory passages for packaging web material 3, varying gradually in section from an open C shape to a substantially circular shape.

As shown in FIG. 2, one of forming units 40 can be angularly moved about its axis by an actuator 41 to adjust angular position of tube 42 with respect to axis A.

Tube 42 of packaging material is then filled continuously with the pourable food product by means of a known filling device 44, and is then fed to a forming and transverse sealing station 45 (shown schematically in FIG. 2 and described in detail, for instance, in EP-A-1325868, whose content is incorporated therein by reference) where it is gripped between pairs of jaws (not shown) that seal the tube transversely to form pillow packs 46.

Pillow packs 46 are then separated by cutting the sealing portion between the packs, and are fed to a final folding station 47 where they are folded mechanically to form finished packages 5.

Packages 5 are obtained by folding the material along bend or fold lines 19, 20, 21, and by controlling the material feed and the angular position of tube 42 (more precisely, the angular position of longitudinal seam 43 of tube 42) with respect to axis A by means of a sensor 48 for "reading" register marks 26 located on the material at intervals R.

More specifically, a control unit 49 receive a position signal from sensor 48 and generates, in a known manner, at least a first controlling signal for assembly 39, in order to position correctly tube 42 about its axis A through actuator 41, a second controlling signal for forming and transverse sealing station 45, in order to position correctly each repeatlength of packaging material (i.e. each pattern of bend or fold lines 19, 20, 21, each pattern created at laser station 11 and each design pattern) with respect to the gripping and sealing jaws, and a third controlling signal for final folding station 47, in order to fold correctly pillow packs 46 along bend or fold lines 19, 20, 21.

In view of the above, the present invention, as described and illustrated with reference to FIGS. 1 to 4, allows to achieve the following advantages over the prior art.

Each register mark 26 is in perfect register with the corresponding pattern 18 of bend or fold lines 19, 20, 21 as the respective operations for applying both of them are synchronized with one another. Besides, since the successive downstream operations in converting plant 1 and also in packaging machine 4 are controlled as a function of the detected position of register marks 26, the tolerance between each printed mark 13 and the corresponding crease pattern 18 has no influence on the manufacturing of web packaging material 3 and packages 5.

Moreover, the process according to the present invention allows the use of reference means (register marks 26) adapted to be easily detected without having to read a bend or fold line, which in practice is extremely difficult and would compulsorily require extremely complicated and expensive sensors; this is particularly advantageous in the case of operations performed in a tube-fed packaging machine, wherein, differently from the bend or fold lines, register marks 26 can be easily read without requiring "external" reference or auxiliary indicia to fully establish the longitudinal and transverse position of the packaging material and its speed.

In particular, in packaging machine 4, for example, register marks 26 can be used as reference means for permitting to correct the position of each repeatlength of packaging material in the vertical direction with respect to the gripping and sealing jaws of forming and transverse sealing station 45 (design correction), and to correct the angular position of tube 42 of packaging material with respect to its axis A (tube-twisting correction).

Furthermore, the process according to the present invention retains the concept of creasing pre-printed material to obtain perfect printing also at the bend or fold lines 19, 20, 21, along which the packaging material is successively mechanically folded to form packages 5.

Finally, the process of the present invention retains high flexibility by enabling the use of various techniques for making the reference means used in all subsequent operations (register marks 26) and various techniques for reading the indicia.

Figure 5:
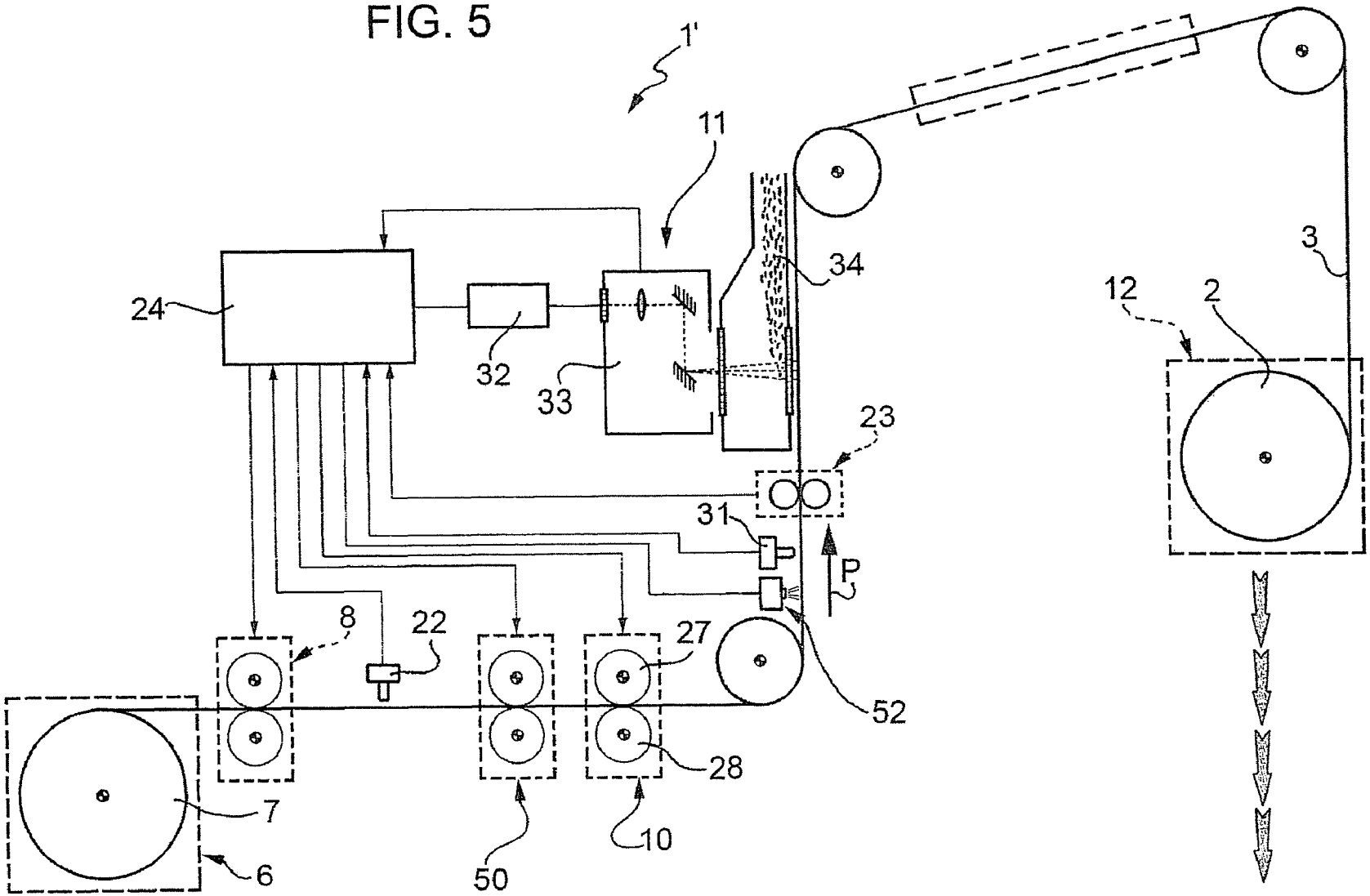
FIG. 5 shows, schematically, another embodiment of a converting plant for performing the process of the present invention on a web packaging material.
Figure 6:
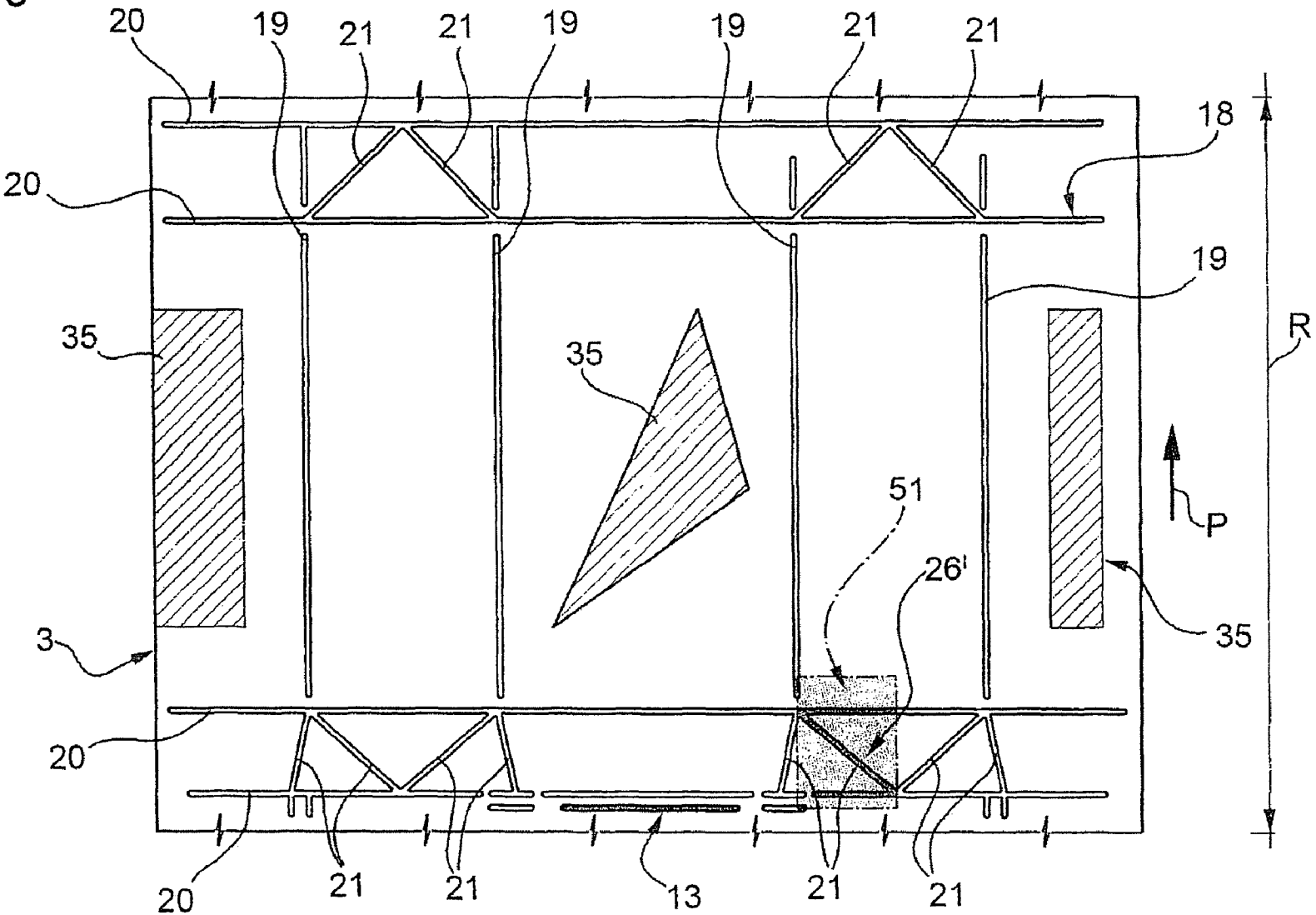
FIG. 6 shows a portion of the web packaging material of FIG. 5, at an enlarged scale.

FIGS. 5 and 6 respectively relate to possible different configurations of the converting plant and the register marks used as reference in the operations following the application of crease pattern 18 on web packaging material 3. Such configurations of the converting plant and the register marks will be indicated hereafter respectively with 1' and 26' and will be described only insofar as they differ from converting plant 1 and register marks 26; the same reference numbers will be used, where possible, for indicating component parts corresponding or equivalent to those already described.

In particular, in converting plant 1', web packaging material 3, before reaching creasing station 9, is fed to an additional printing station 50, wherein a transparent or a one-colour area 51 of web 3 (FIG. 6) is printed with a light-sensitive ink at a position where part of crease pattern 18 will be subsequently applied.

According to a possible alternative not shown, this operation may be also performed in connection with the operation for printing the repeated design pattern 35 and/or the operation for printing register mark 13.

After web packaging material 3 is creased at creasing station 9, the part of crease pattern 18 lying on printed area 51 is illuminated by an illuminating device 52 using a laser source or another light source. In this way, the part of crease pattern 18 lying on printed area 51 is activated, e.g. may change colour, and can be easily detected by sensor 31.

The activated zone of printed area 51 defines a new register mark 26', which will be used as reference for performing the subsequent operations.

Also in this case, register mark 26' is perforce obtained in a synchronized way with the step of applying crease pattern 18.

Moreover, register mark 26' defines a reference element which is clearly distinct from crease pattern 18. In other words, register mark 26' can be easily distinguished from the remaining part of crease pattern 18, without using complicated sensors.

According to a possible alternative not shown, printing station 50 may be used to print area 51 of web 3 with a pressure-sensitive ink. In this case, activation of the ink would be performed as a result of the application of crease pattern 18 on the printed area 51, therefore without need for illuminating device 52.

The embodiment shown with reference to FIGS. 5 and 6 and the above-mentioned alternative allow to achieve the following advantages.

Also in this case, as indicated in the part relative to the embodiment of FIGS. 1 to 4, each register mark 26' is in perfect register with the corresponding pattern 18 of bend or fold lines 19, 20, 21, being defined by the profile of a part of such pattern 18.

Differently from reading a bend or fold line, detecting ink-activated register marks 26' only requires the use of normal sensors, such as photodiodes, for detecting printed marks. This is particularly advantageous in the case of operations performed in a tube-fed packaging machine, wherein register marks 26' can be easily detected.

Clearly, further changes may be made to the process and packaging equipment as described and illustrated herein without, however, departing from the scope of protection defined by the accompanying Claims.

The invention claimed is:

1. A process of manufacturing sealed packages containing a pourable food product from a web packaging material moving along a predetermined path, said process comprising:

providing a printed register mark on said web packaging material;

applying a recurring pattern of bend or fold lines on said web packaging material as a function of a position of said printed register mark;

generating on said web packaging material new reference means for providing a reference on said web packaging material, the new reference means being generated in a synchronized way with respect to application of the recurring pattern of bend or fold lines, said new reference means being distinct from said pattern of bend or fold lines; and performing one or more subsequent operations on said web packaging material based on a synchronization pulse created by detection of said new reference means.

2. A process as claimed in claim 1, wherein said step of generating said new reference means comprises:

printing an area of said web packaging material with a pressure- or light-sensitive ink; and activating said ink at the part of said pattern of bend or fold lines lying on said printed area.

3. A process as claimed in claim 2, wherein the printing of the area of the web comprises printing the pressure-sensitive ink and wherein the activation of said ink is performed as a result of the application of the bend or fold lines on the printed area.

4. A process as claimed in claim 2, wherein the printing of the area of the web comprises printing the light-sensitive ink and wherein activation of said ink is performed by illuminating the part of the pattern of bend or fold lines lying on the printed area.

5. A process as claimed in claim 1, wherein the application of the pattern of bend or fold lines on said web packaging material is performed by first operating means for operating to apply the pattern of bend or fold lines, and wherein said new reference means are applied on said web packaging material by second operating means for operating to apply the new reference means, the second operating means being synchronized with said first operating means.

6. A process as claimed in claim 5, wherein the application of said new reference means is performed by compressing a predetermined pattern on at least one side of said web packaging material.

7. A process as claimed in claim 1, wherein said subsequent operations include at least one operation of cutting, perforating, creasing or scoring a pattern on said web packaging material by local vaporization of the web packaging material with at least one controllable laser beam movable from a fixed point in at least two perpendicular directions.

8. A process as claimed in claim 1, wherein said subsequent operations include folding gradually said web packaging material into a cylinder and longitudinally sealing the cylinder to form a vertical tube filled continuously with said pourable food product, the tube possessing a tube axis, and wherein tube twisting with respect to the tube axis, during said operations of folding into a cylinder and longitudinally sealing, are controlled as a function of a detected position of said new reference means.

9. A process as claimed in claim 1, wherein said subsequent operations include gripping, sealing and cutting said tube of packaging material along transverse sections to form pillow packs, and wherein the material feed, during said gripping, sealing and cutting, is controlled as a function of a detected position of said new referenced means.

10. A process as claimed in claim 9, wherein said subsequent operations include further folding said pillow packs along said bend or fold lines and as a function of the detected position of said new reference means.

* * * * *